US006126126A

United States Patent [19]

McKiernan, Jr.

[11] Patent Number: 6,126,126

[45] Date of Patent: Oct. 3, 2000

[54] TACK WITH THREE PRONGS

[76] Inventor: Robert D. McKiernan, Jr., 1086 Twinfoot Ct., Westlake Village, Calif. 91361

[21] Appl. No.: 09/099,791

[22] Filed: Jun. 18, 1998

[51] Int. Cl.[7] ..... A47B 96/06

[52] U.S. Cl. ..... 248/217.3; 248/497

[58] Field of Search ..... 248/216.1, 217.3, 248/489, 493, 497, 546, 475.1, 215, 216.4, 218.3

[56] References Cited

U.S. PATENT DOCUMENTS

| | | | |
|---|---|---|---|
| 165,206 | 7/1875 | Brown | 248/489 |
| 770,163 | 9/1904 | Cobb | 248/217.2 |
| 1,272,696 | 7/1918 | Mock | 411/460 |
| 2,282,631 | 5/1942 | Winship | 411/516 |
| 2,693,927 | 11/1954 | Gardenr | 248/263 |
| 3,063,669 | 11/1962 | Bell | 248/549 |
| 3,966,157 | 6/1976 | Corral et al. | 248/217.3 |

FOREIGN PATENT DOCUMENTS

| | | | |
|---|---|---|---|
| 1067111 | 6/1954 | France | 248/497 |
| 676903 | 8/1952 | United Kingdom | 248/497 |

*Primary Examiner*—Ramon O. Ramirez
*Assistant Examiner*—David Heisey

[57] ABSTRACT

A tack having a generally rigid flat body with three prongs extending from one generally flat face and a hook extending from the other generally flat face.

9 Claims, 5 Drawing Sheets

TACK WITH THREE PRONGS

TECHNICAL FIELD

This invention relates to the general field of tacks or pushpins and more particularly to an improved three prong tack which is useful for affixing documents, notes, memos, calendars, or the like to office cubicle walls and/or partitions.

BACKGROUND OF THE INVENTION

It is well know that office cubicle walls and/or partitions are made from a fabric covered support frame containing an internal substrate. While the support frame is usually of a lightweight metallic structure, the substrate is normally made of a padded material and serves to provide sound attenuation between the office cubicles. This substrate can also serve as a medium into which pushpins or tracks can be inserted for supporting general office memoranda and the like on the cubicle partition wall.

In most instances, the fabric or the fabric backed by the substrate does not have sufficient density to support any significant weight suspended from a conventional pushpin or tack. This allows the pushpin to release from the partition wall, thus permitting whatever is suspended from the pushpin to fall from the wall.

SUMMARY OF THE INVENTION

The invention comprises a molded assembly consisting of a plastic body and a plurality of metallic pins disposed in the body and projecting from the back surface thereof. The front of the body includes an upwardly projecting hook.

It is the principal object of the present invention to provide an improved pushpin or tack for use on offices cubical walls and/or partitions. The overall design is to eliminate the inadvertent release common to conventional pushpins and tacks from the soft office cubicle wall and/or partition.

BRIEF DESCRIPTION OF THE DRAWINGS

Figure 1:
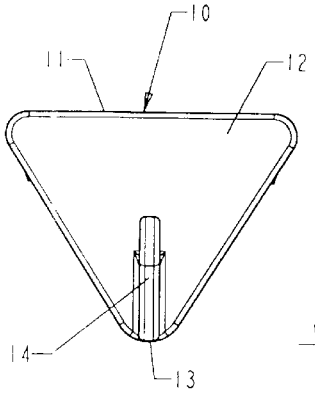
Figure 2:
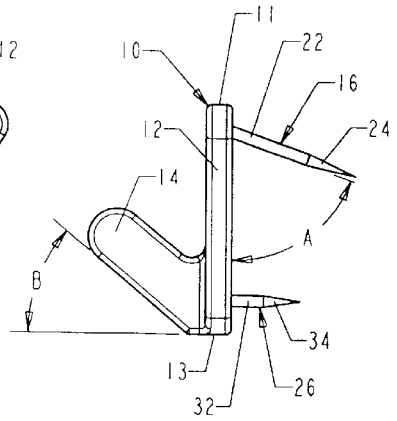
Figure 3:
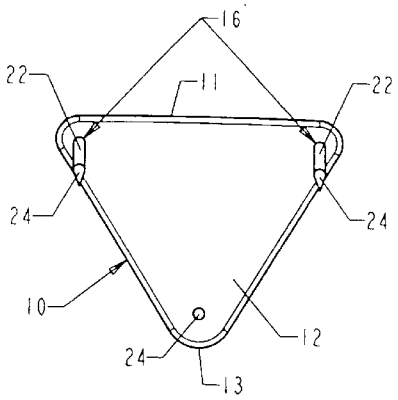
Figure 4:
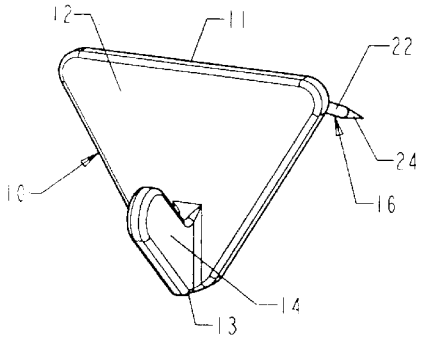

Having thus described the present invention in general terms, reference will now be made to the accompanying drawings in which:

FIG. 1 is a front view of the three prong tack of the present invention;

FIG. 2 is side view of the three prong tack of FIG. 1;

FIG. 3 is a back view of the three prong tack of FIGS. 1 and 2;

FIG. 4 is a perspective view of the three prong tack of FIGS. 1–3.

Figure 5:
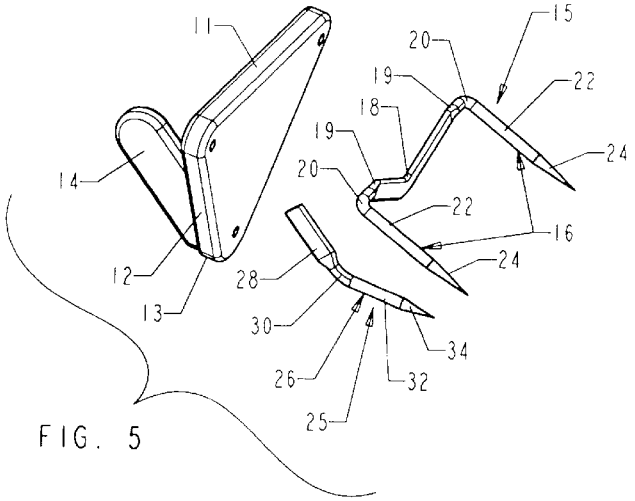
Figure 6:
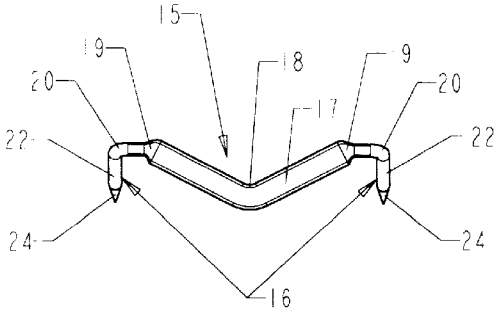
Figure 7:
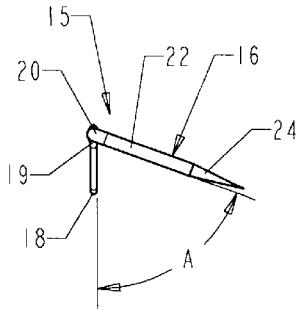
Figure 8:
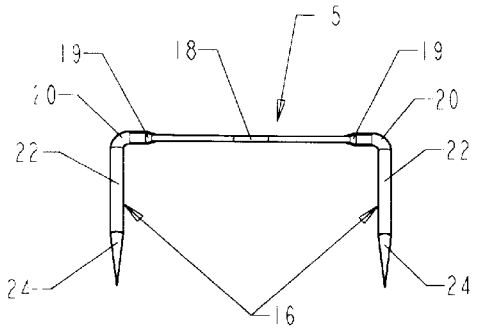
Figure 9:
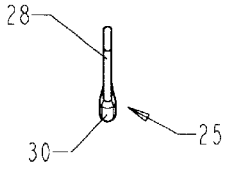
Figure 10:
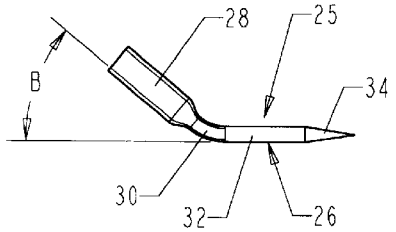
Figure 11:
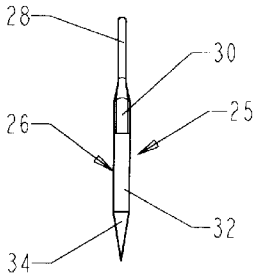
Figure 12:
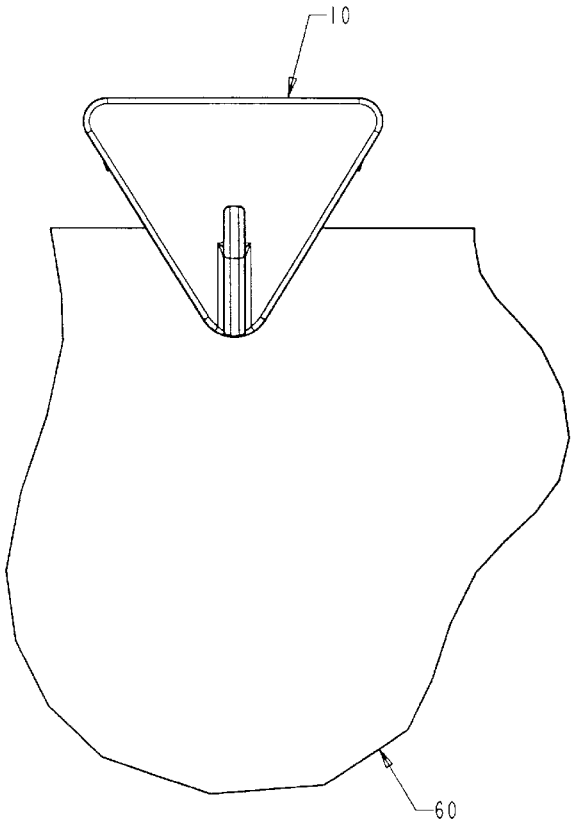
Figure 13:
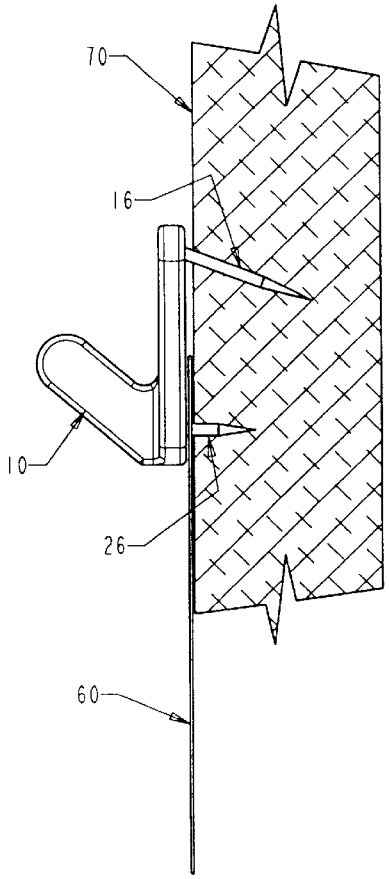
Figure 14:
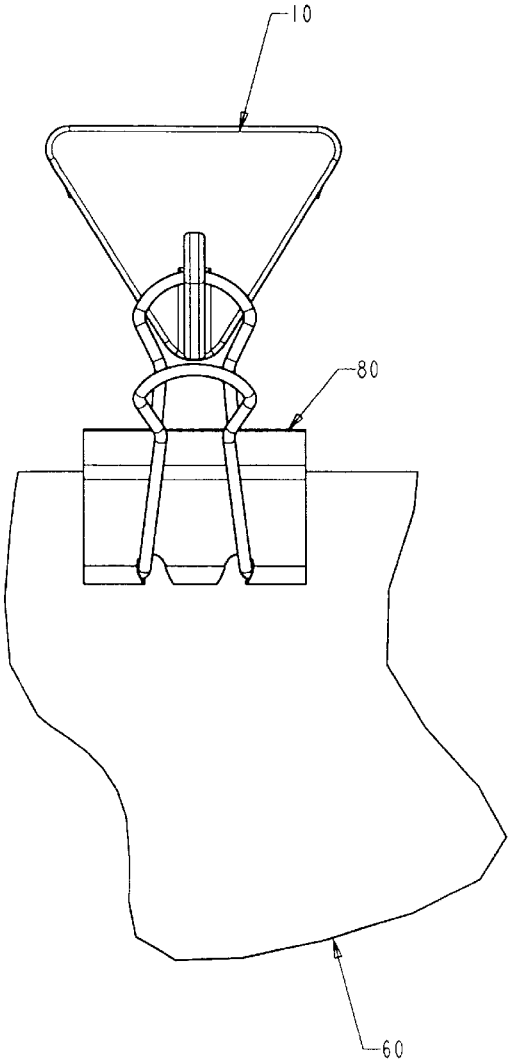
Figure 15:
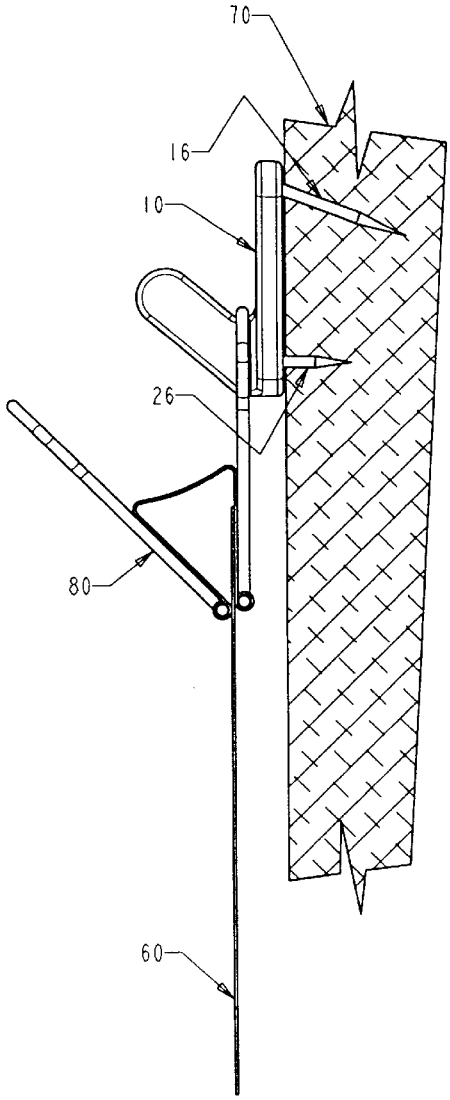
Figure 16:
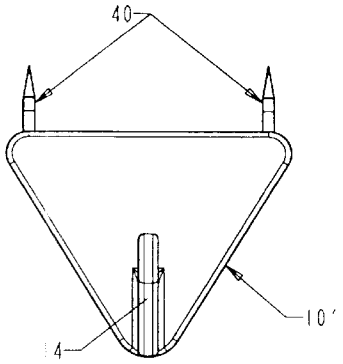
Figure 17:
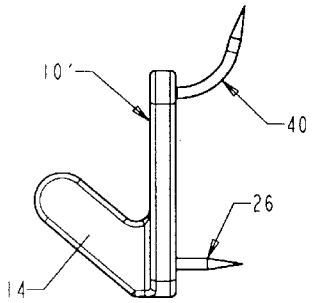
Figure 18:
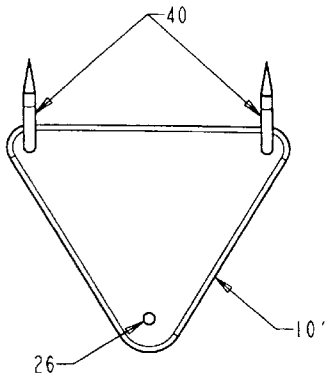
Figure 19:
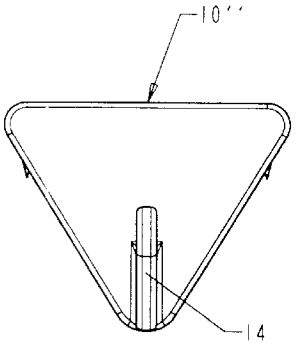
Figure 20:
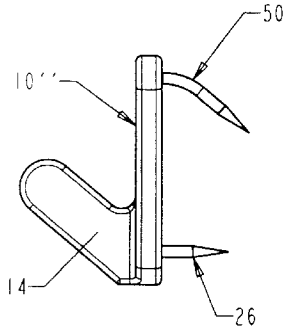

FIG. 5 is a exploded view of the body, upper pin and lower pin of the three prong tack of FIG. 4;

FIG. 6 is a front view of the upper pin of FIG. 5;

FIG. 7 is a side view of the upper pin of FIG. 5;

FIG. 8 is a bottom view of the upper pin of FIG. 5;

FIG. 9 is a front view of the lower pin of FIG. 5;

FIG. 10 is a side view of the lower pin of FIG. 5;

FIG. 11 is a bottom view of the lower pin of FIG. 5;

FIG. 12 is a front view of the three prong tack having a paper hung on the lower pin thereof;

FIG. 13 is a side view, partially in section, of the three prong tack of FIG. 12 engaged with an office partition;

FIG. 14 is a front view of the three prong tack having a spring clip hung from the tack hook;

FIG. 15 is a side view, partially in section, of the three prong tack of FIG. 14 engaged with an office partition;

FIG. 16 is a front view of the three prong tack of the present invention with an alternative upper pin configuration;

FIG. 17 is side view of the three prong tack of FIG. 16;

FIG. 18 is a back view of the three prong tack of FIGS. 16 and 17;

FIG. 19 is a front view of the three prong tack of the present invention with another alternative upper pin configuration;

FIG. 20 is a side view of the three prong tack of FIG. 19; and

Figure 21:
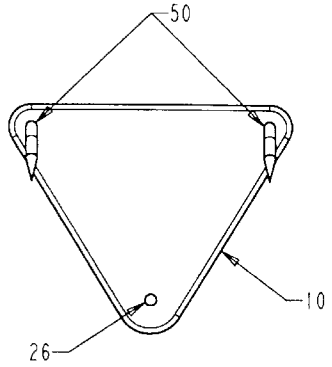

FIG. 21 is a back view of the three prong tack of FIGS. 19 and 20.

DETAILED DESCRIPTION OF THE PREFERRED EMBODIMENTS

The three prong pushpin or tack 10 of the present invention is illustrated in FIGS. 1–21. This tack 10 generally consists of a flat, triangular plastic body 12 with one side of the triangular body 12 serving as an upper edge 11 and the tip 13 of the triangular body 12 opposed to the upper edge 11 pointing downward. The front of the downward pointing tip 13 of the body 12 includes an upwardly extending hook 14 which may be formed integral with the body 12 at an angle "B" with respect to the plane normal to the tack body 12.

The tack body 12 includes an upper pin 15 (FIGS. 6–8) and a lower pin 25 (FIGS. 9–11) which establish three cleats or prongs on the back surface of the tack body 12. There are two upper pin prongs 16, one at each end of the upper edge 11. These upper pin prongs extend downward from the rear surface of the flat triangular tack body 12 at an angle "A". A single lower pin prong 26 projects straight back at an angle of 90 degrees from the downward pointing tip 13 of the tack body 12.

The upper pin 15 may be of a metallic construction having a plurality of bends 18, 19, and 20 and is generally illustrated in detail in FIGS. 5–8. These bends allow for the upper pin 15 to be properly positioned within the molded tack body 12. The corner bends 20 are essential to the design since it establishes the angle "A" which projects the upper pin prongs 16 downward from the rear of the tack body 12. Between the two intermediate bends 19, the central section of the upper pin 15 can be flattened to increase the surface area for bonding the upper pin 15 within molded tack body 12, add reinforcement for mechanical stiffness to molded tack body 12, and improve the positioning of the upper pin 15 within the molded tack body 12. The projections of upper pin 15 that extend out the back side of molded tack body 12, namely the upper pin prongs 16, each consist of a straight cylindrical section 22 and an elongated point 24 to allow the upper pin prongs 16 to be easily inserted into an office cubical wall or partition.

The lower pin 25 can also be metallic and includes a flattened section 28, bend 30, straight cylindrical section 32 and elongated point 34 as shown in detail in FIGS. 9–11. The lower pin bend 30 permits the lower pin flattened section 28 to extend up into the hook 14 and provides increased bonding area within the molded hook 14, mechanical strength to hook 14 and proper orientation to the lower pin prong 26 consisting of the lower pin straight cylindrical section 32 and lower pin elongated point 34.

The upper pin 15 and lower pin 25 can be injection molded into tack body 12 by conventional injection molding techniques. The upper pin 15, lower pin 25, and tack body 12 would together form a rigid integral structure with the upper pins prongs 16 and lower pin prong 26 projecting out from the back of the tack body 12.

FIGS. 12 and 13 illustrate the tack 10 holding a paper 60 such as a document, note, memo, or the like on the lower pin prong 26 against an office cubical or partition wall 70. The elongated point 34 of the lower pin prong 26 can be inserted through the paper 60 and the upper pin prongs 16 inserted into the partition wall 70. After the upper pin prongs 16 are inserted, the tack 10 can be rotated downward to insert the lower pin prong 26 into the partition wall 70 to complete the mounting. Alternately, the paper 60 can be pierced by the elongated point 34 of the lower pin prong 26 after the upper pin prongs 16 have been inserted into the partition wall 70.

FIGS. 14 and 15 illustrate how a spring clip 80 can be hung from the tack hook 14. The spring clip can then be used to hold a paper 60 without the paper 60 being pierced by the lower pin prong 26.

The molded plastic tack body 12 can be made of any color that provides an appealing appearance to the user or the user's decor. While the shape of the plastic body 12 is shown as generally flat and triangular with a prong provided at each corner or point thereof, the shape of the plastic body 12 and hook 14 can be other shapes that can fill the ergonometric necessities and provide an appealing appearance. The two upper pin prongs are slanted downward to provide a cleat when inserted into the office cubical or partition wall. This slant prevents the tack 10 from releasing and thus digs into the wall when any load is applied.

Not only can the upper pin 15 be configured as a straight slanted cleat or prong, the upper pin can also be designed as an upward curved cleat or prong 40 as depicted in FIGS. 16–18 or a downward curved cleat or prong 50 as depicted in FIGS. 19–21. These curved cleat arrangements allows the prongs 40 or 50 to loop into the office cubicle or partition wall substrate providing a hooking action that is independent of an applied load necessary for otherwise digging the upper pin prong 16 into the wall. The lower pin prong 26 at the lower tip 13 of the molded tack body 12 remains normal to the surface of the tack body 12 and can be used to tack paper or the like to the wall in lieu of the using the plastic hook 14.

In either instance with the upward curved prong 40 or downward curved prong 50, the hook 14 would be held between the user's thumb and one finger or between two fingers and the tack and the curved prongs 40 or 50 inserted into the office cubicle wall or partition with the lower pin prong 26 held away from the office cubicle wall or partition until the curved prongs 40 or 50 are fully inserted. Once the curved prongs 40 or 50 are fully inserted into the office cubicle wall or partition, the tack body 12 is rotated downward and the lower pin prong 26 then inserted into the office cubicle wall or partition.

While specific embodiments of the invention have been illustrated and described, it is to be understood that these are provided by way of example only and that the invention is not to be construed as being limited thereto but only by the proper scope of the following claims.

What I claim is:

1. A tack comprising:

a generally flat triangular plastic body;

three pointed metallic prongs extending rearwardly from said generally flat triangular plastic body with one metallic prong disposed at each corner of the generally flat triangular plastic body;

the two pointed metallic prongs at the upper corners of said generally flat triangular plastic body angled with respect to the rear surface of said generally flat triangular plastic body and the pointed metallic prong at the lower corner of said generally flat triangular plastic body extends normal to said generally flat triangular plastic body; and a plastic hook disposed at the lower corner of said generally flat triangular plastic body extending upwards from the front of said body;

wherein said generally flat triangular body is plastic molded, said two upper corner angled pointed metallic prongs are joined together within said molded plastic body, and said lower corner pointed metallic prong extends through said generally flat triangular plastic body into said front plastic hook.

2. The tack of claim 1 wherein said two angled pointed metallic prongs disposed at the upper corners of said triangular shaped relatively rigid generally flat plastic body are slanted downward.

3. The tack of claim 1 wherein said two angled pointed metallic prongs disposed at the upper corners of said triangular shaped relatively rigid generally flat plastic body are curved downward.

4. The tack of claim 1 wherein said two angled pointed metallic prongs disposed at the upper corners of said triangular shaped relatively rigid generally flat plastic body are slanted upward.

5. The tack of claim 1 wherein said two angled pointed metallic prongs disposed at the upper corners ends of said triangular shaped relatively rigid generally flat plastic body are joined together by a flattened and bent metallic section within said generally triangular shaped relatively rigid flat plastic body.

6. The tack of claim 1 wherein said lower corner pointed metallic prong is flattened where said prong extends within said generally flat triangular plastic body into said front plastic hook.

7. The tack of claim 1 wherein said two angled pointed metallic prongs disposed at the upper corners of said triangular shaped relatively rigid generally flat plastic body are joined together by a flattened and bent metallic section within said triangular shaped relatively rigid generally flat plastic body and said lower corner pointed metallic prong is flattened where said prong extends within said triangular shaped relatively rigid generally flat triangular plastic body into said front plastic hook.

8. The tack of claim 1 wherein said three pointed prongs are cylindrical having an elongated tapered point.

9. A tack, comprising:

a generally flat triangular rigid plastic body having a straight upper edge and a generally pointed bottom;

three pointed metallic prongs extending rearwardly from said generally flat triangular rigid plastic body with one metallic prong disposed at each corner of the generally flat triangular rigid plastic body;

a plastic hook disposed at the lower corner of said generally flat triangular rigid plastic body extending upwards from the front of said body;

the two pointed metallic prongs at the upper corners of said generally flat triangular rigid plastic body angled with respect to the rear surface of said generally flat triangular rigid plastic body and joined together by a flattened and bent metallic section within said generally flat triangular rigid plastic body; and the pointed metallic prong at the lower corner of said generally flat triangular rigid plastic body extending normal to said generally flat triangular rigid plastic body and flattened where said prong extends through said generally flat triangular rigid plastic body into said front plastic hook.

* * * * *